US008033727B2

(12) United States Patent
Gattino

(10) Patent No.: US 8,033,727 B2
(45) Date of Patent: Oct. 11, 2011

(54) TRANSPARENT BAG FOR CARRYING, DISPLAYING, CHILLING AND SERVING A BEVERAGE IN A BEVERAGE CONTAINER

(75) Inventor: Samy Gattino, Palaiseau (FR)

(73) Assignee: Gimex International S.A., Cedex (FR)

( * ) Notice: Subject to any disclaimer, the term of this patent is extended or adjusted under 35 U.S.C. 154(b) by 1072 days.

(21) Appl. No.: 11/881,755

(22) Filed: Jul. 27, 2007

(65) Prior Publication Data

US 2008/0063318 A1 Mar. 13, 2008

(30) Foreign Application Priority Data

Sep. 8, 2006 (FR) ..... 06/4097

(51) Int. Cl.

| | |
|---|---|
| ***B65D 33/06*** | (2006.01) |
| ***B65D 33/00*** | (2006.01) |
| ***B65D 30/22*** | (2006.01) |
| ***B65D 33/04*** | (2006.01) |
| ***B65D 30/00*** | (2006.01) |
| ***B65D 30/18*** | (2006.01) |

(52) U.S. Cl. ..... 383/20; 383/26; 383/33; 383/38; 383/40; 383/106; 383/107; 383/122

(58) Field of Classification Search ..... 383/6, 17, 383/20, 33, 40, 25, 122, 907, 18, 19, 26, 383/27, 106, 107, 38

See application file for complete search history.

(56) References Cited

U.S. PATENT DOCUMENTS

| | | | | | |
|---|---|---|---|---|---|
| 1,448,693 | A | * | 3/1923 | Magill et al. | 383/20 |
| 1,974,457 | A | * | 9/1934 | Groh | 383/20 |
| 2,454,013 | A | * | 11/1948 | Scherzinger | 383/2 |
| 2,575,893 | A | * | 11/1951 | Seaman | 383/25 |
| 2,664,131 | A | * | 12/1953 | Miller | 383/12 |
| 2,754,869 | A | * | 7/1956 | Bartels | 383/12 |
| 3,006,165 | A | * | 10/1961 | Mittelberger | 62/371 |
| 3,119,494 | A | * | 1/1964 | Rosenstiel | 206/216 |
| 4,196,817 | A | * | 4/1980 | Moser | 215/12.1 |
| 4,290,525 | A | * | 9/1981 | Sisson | 206/427 |
| 4,428,484 | A | | 1/1984 | Rattay et al. | |
| 4,819,793 | A | * | 4/1989 | Willard et al. | 206/162 |
| 5,088,838 | A | * | 2/1992 | Yeh | 383/33 |
| 5,651,254 | A | | 7/1997 | Berry | |

(Continued)

FOREIGN PATENT DOCUMENTS

GB 2211079 A * 6/1989

OTHER PUBLICATIONS

"Packaging," Hong Kong Chamber of Commerce, vol. 2, 2002, Hong Kong Trade Development Council.

*Primary Examiner* — Jes F Pascua

(74) *Attorney, Agent, or Firm* — Abelman, Frayne & Schwab

(57) ABSTRACT

A collapsible rectilinear or cylindrical ice bucket for transporting, displaying and chilling a wine bottle or other beverage container is fabricated from a deformable, water-impermeable and polymeric material, and is dimensioned to receive the bottle and a sufficient quantity of crushed ice or ice cubes. The upper edges of the collapsible ice bucket have a double thickness of the material for retaining the opening in a substantially non-collapsed state during use, and is provided with a handle.

26 Claims, 6 Drawing Sheets

U.S. PATENT DOCUMENTS

| | | | | |
|---|---|---|---|---|
| 5,957,354 | A * | 9/1999 | Mentken | 224/614 |
| 6,176,613 | B1 * | 1/2001 | Chen | 383/3 |
| 6,523,738 | B1 * | 2/2003 | Sarne et al. | 229/101 |
| D494,853 | S | 8/2004 | Chan | |
| 6,890,101 | B2 | 5/2005 | Blau | |
| D510,265 | S | 10/2005 | Man | |
| D512,306 | S | 12/2005 | Man | |
| 6,990,786 | B2 | 1/2006 | Kilmartin | |
| 7,118,276 | B2 | 10/2006 | Clark | |

* cited by examiner

FIG. 2
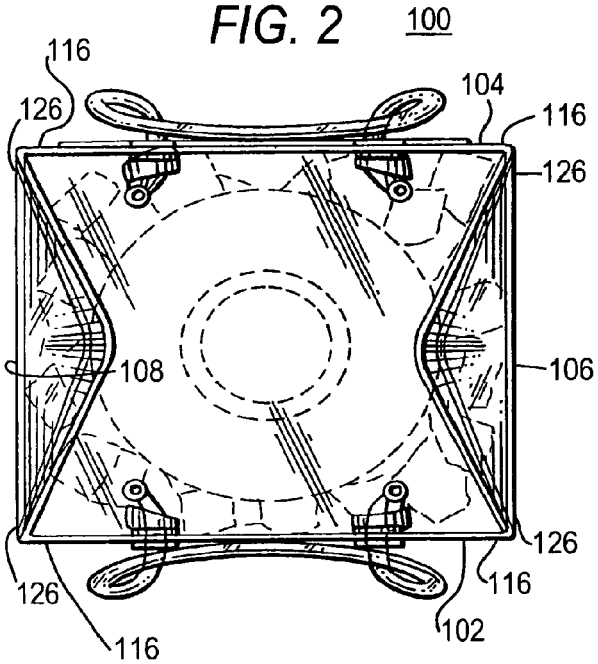
FIG. 3
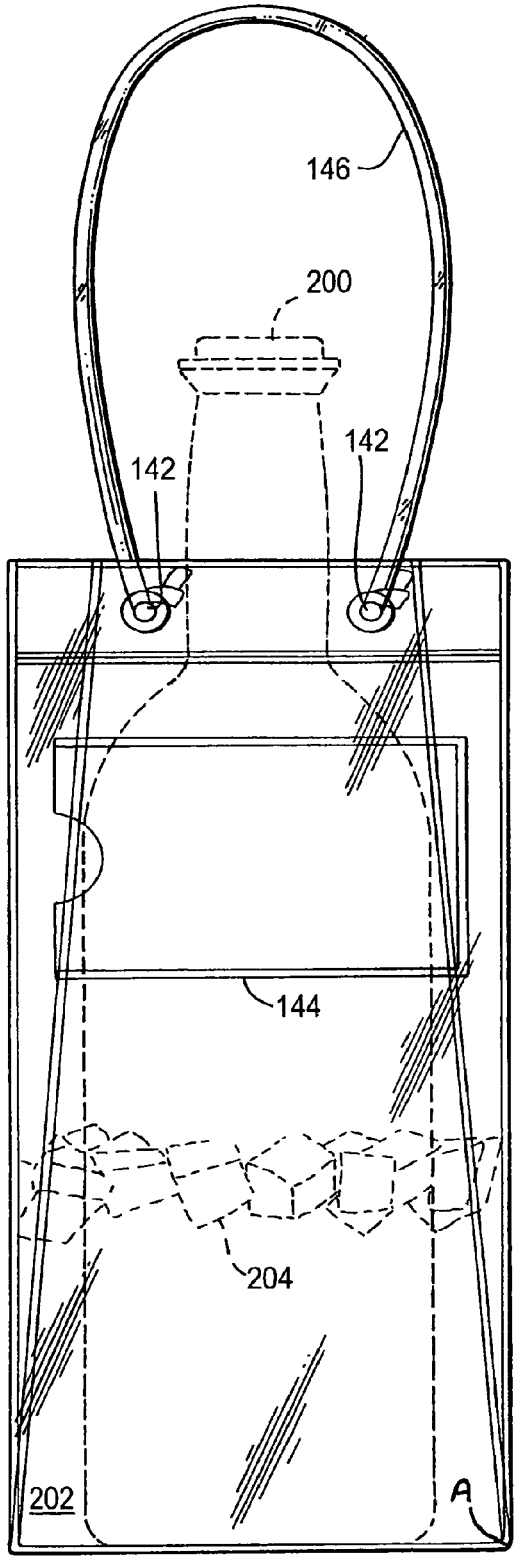
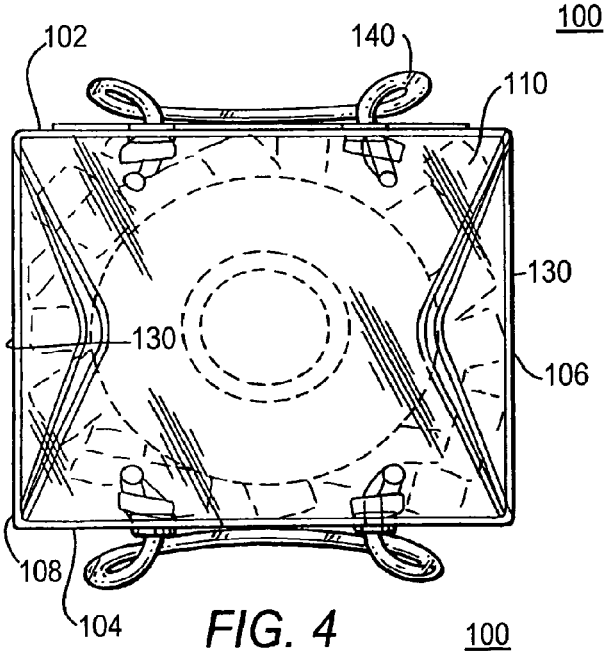
FIG. 4

100

TRANSPARENT BAG FOR CARRYING, DISPLAYING, CHILLING AND SERVING A BEVERAGE IN A BEVERAGE CONTAINER

CROSS REFERENCE TO RELATED APPLICATION

This patent application is related to U.S. Design application, Ser. No. 29/268,208, filed Oct. 31, 2006, the contents of which are incorporated by reference herein.

BACKGROUND OF THE INVENTION

1. Field of the Invention

The present invention generally relates to ice buckets, and more particularly, to a collapsible water-impermeable ice bucket for carrying, displaying, chilling and serving a beverage, such as wine, in a beverage container.

2. Description of the Related Art

Ice buckets and coolers suitable for cooling or chilling beverages stored in a container, such as wine bottles, spirits or other drinks are conventionally known in the art. For example, ice buckets are often used to chill bottles of wine by waiters at restaurants and by consumers at their residences. Although ice buckets and containers are typically aesthetically pleasing, they are not convenient for transporting, displaying, chilling and serving the wine from a bottle or other beverage container.

In U.S. Pat. No. D494,853 to Chan, a rectangular gift bag with water container is shown and described in an open and folded configuration. Although the gift bag is designed to retain water therein, the design patent fails to disclose the materials or construction methods used during fabrication of the bag. Further, there is no disclosure regarding the ability to display content other than water in the bag, or its suitability to chill a beverage in a beverage container.

In U.S. Pat. No. 7,118,276 to Clark, a gift bag is disclosed which fabricated from a napped filamentary material, such as woven fabric. Although the gift bag is suitable for transporting content, the gift bag is incapable of retaining water and ice to chill a beverage in a beverage container.

U.S. Pat. No. 6,890,101 to Blau discloses a transparent plastic bag or container fabricated from non-rigid plastic sheets which can be easily folded. The clear plastic sheets are attached to gusset members, which function to attach the various plastic panels to one another and to provide rigidity to the bag structure. Although the transparent bag can be used for displaying or storing content, the patent is silent as to the fabrication material and techniques of the gussets, and accordingly, whether the bag is capable of retaining water and ice to chill a beverage in a beverage container.

U.S. Pat. No. 6,990,786 to Kilmartin discloses a method of advertising on wine and spirits bottles, which provides both advertising and a way to protect the bottles from damage in a shopping bag or box. Bottle packaging dividers are imprinted with advertising material, and then distributed to retail sellers of wine and spirits so that employees may use the bottle packaging dividers to cushion the wine and spirit bottles sold by them to consumers, while at the same time providing an advertising vehicle. Although the bag of the Kilmartin patent is suitable for transporting alcoholic beverage containers, the patent provides no indication that the bag can be used to retain water and ice to chill beverages in the beverage containers therein.

U.S. Pat. No. 5,651,254 to Berry discloses a freezable container which uses water that is frozen to keep a beverage cold, and which does not require that the beverage be placed into the freezer along with the container filled with water. The freezable container has a removable sleeve placed concentrically inside the container and held in place by a pair of rods. Water is placed between the container and the sleeve and both are placed in the freezer. When the water has frozen, the container is removed from the freezer and the sleeve is removed from the container to allow a beverage container to be placed into the container in place of the sleeve. Although the ice container is suitable for chilling and displaying the beverage container (e.g., wine bottle), the device is not suitable for transporting the beverage container.

U.S. Pat. No. 4,428,484 to Rattay, et al. discloses a portable wine bottle carrier configured as a tote bag having a non-rigid bottom, sides and an open top. The bag is formed from a single piece of fabric material such as cotton duck, such single piece of material having a medial portion forming the bottom and end portions extending upwardly from the edges of such medial portion to form the sides of the bag, such end portions having vertical juxtaposed edges stitched together at seams. Although the tote bag is suitable for transporting alcoholic beverage containers, the patent provides no indication that the bag can be used to retain water and ice to chill a beverage in a beverage container.

SUMMARY OF THE INVENTION

The disadvantages heretofore associated with the prior art are overcome by the present invention of a collapsible ice bucket for carrying, displaying, chilling and serving a beverage in a beverage container, such as a bottle of wine, spirits or other beverage.

In one embodiment, the ice bucket includes at least one side panel each side panel having an upper edge, a lower portion, and two lateral edges, where adjacent lateral edges are joined to form a tubular structure. A bottom panel is joined to the lower portion of the at least one side panel to form an interior portion of the ice bucket, which is defined by the at least one panel and the bottom panel, and an opening defined as the distance between opposing upper edges of the at least one panel. The at least one panel and bottom panel of the ice bucket are formed from a deformable, water-impermeable and transparent material for displaying and chilling the beverage container. The upper edges of the ice bucket have a double thickness of the deformable, water-impermeable and transparent material for retaining the opening in a substantially non-collapsed state during use. At least one handle extends from at least one of the upper edges of the panels.

In another embodiment, the ice bucket includes substantially parallel front and back panels, each having an upper edge, a lower portion opposite the upper edge, and two lateral edges, as well as a pair of substantially parallel side panels, each having an upper edge, a lower edge opposite the upper edge, and two lateral edges. The lateral edges of the front and back panels are joined to the lateral edges of the side panels.

The ice bucket further includes a bottom panel having at least one pair of opposing lateral edges, wherein the lateral edges of the bottom panel are joined to the lower edges of the side panels to form an interior portion of the ice bucket defined by the front, back, pair of side panels and the bottom panel, and an opening defined as the distance between the upper edges of the front, back and side panels.

The front, back, side and bottom panels of the ice bucket are formed from a material that is deformable, water-impermeable and transparent for displaying and chilling the beverage in its container. Preferably, the upper edges of the ice bucket have a double thickness of the deformable, water-impermeable and transparent material for retaining the opening in a substantially non-collapsed state. The collapsible ice bucket further includes a pair of handles, wherein one handle is attached to the upper edge of the front panel and the other handle is attached to the upper edge of the back panel for carrying the beverage container in the ice bucket.

In one embodiment, the front, back, bottom, and side panels are formed from a flexible polymeric material. Preferably, the polymer material is polyvinyl chloride or polypropylene, although such materials are not considered as being limiting.

In one embodiment, the front, back and bottom panels of the collapsible ice bucket are formed from a single sheet of the deformable, water-impermeable and transparent material. The lateral edges of the front and back panels can be welded by heat bonding to the opposing lateral edges of the side panels, and the pair of substantially parallel opposing lateral edges of the bottom panel can be welded respectively to the lower edges of the side panels. In one embodiment, the welded corners formed by the pair of lateral edges of the bottom panel and the lower edges of the side panels are rounded in shape.

In another embodiment, the bottom panel of the collapsible ice bucket includes two pairs of substantially parallel opposing lateral edges forming a rectangular shape. The lateral edges of the front and back panels can be welded to the opposing lateral edges of the side panels, one of the two pair of substantially parallel opposing lateral edges of the bottom panel can be welded respectively to the lower edges of the side panels, and the other pair of substantially parallel opposing lateral edges of the bottom panel can be welded respectively to the lower portions of the front and back panels. In one embodiment, the welded corners formed by the two pairs of lateral edges of the bottom panel, the lower edges of the side panels and the lower portions of the front and back panels are rounded in shape.

The deformable, water-impermeable and transparent material can have a thickness in the range of approximately 0.3 to 1.0 millimeters. Preferably, the deformable, water-impermeable and transparent material has a thickness of approximately 0.5 millimeters. Accordingly, the ice bucket can be easily folded over itself for storage by an end user.

In one embodiment, the handles are attached to the front and back panels by passing through a pair of apertures in each of the panels. Preferably, the handles are formed from a tubular water-impermeable material. In alternative embodiments, the handles can be formed from other materials, such as chain link, wire, silk, cloth, cord, yarn, among other flexible materials.

In yet another embodiment, the ice bucket includes at least one pocket mounted on at least one of the exterior surfaces of the front and back panels. Preferably, the pocket is transparent and sized to receive an advertisement, a business card, and/or a gift card, a menu from a restaurant, a photographic picture, among other flattened or slim line objects.

BRIEF DESCRIPTION OF THE DRAWINGS

The teachings of the present invention can be readily understood by considering the following detailed description in conjunction with the accompanying drawings, in which:

FIG. 2 is a top plan view taken along line 2-2 of FIG. 1 showing the general configuration of the ice bucket;

FIG. 3 is a side view of FIG. 1 showing the general configuration of the ice bucket;

FIG. 4 is a bottom plan view taken along line 4-4 of FIG. 1 showing the general configuration of the ice bucket;

Figure 1:
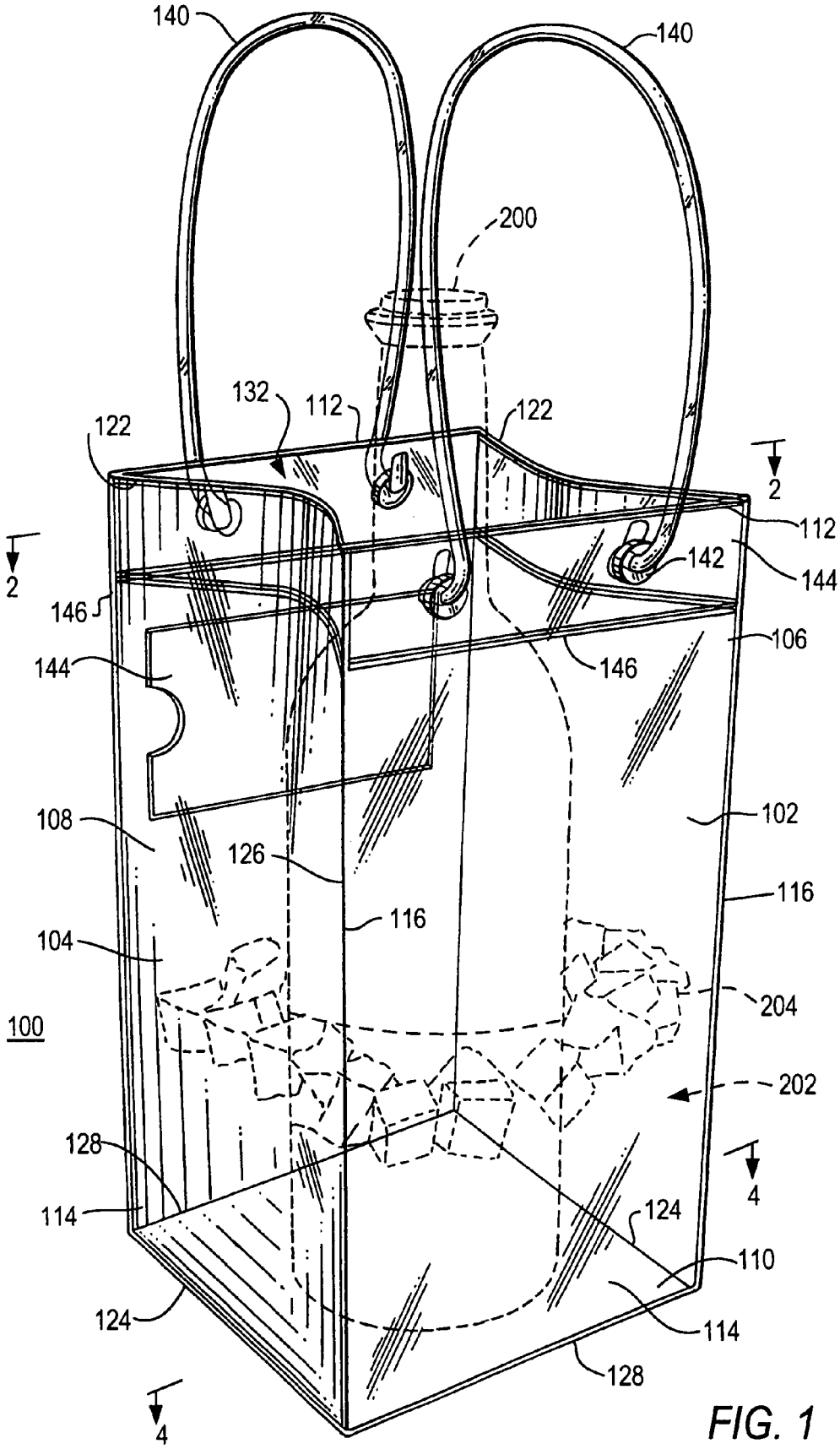
FIG. 1 is a right, front, perspective view of a collapsible ice bucket of the present invention for carrying, displaying, chilling and serving a beverage in a beverage container.

To facilitate understanding of the invention, identical reference numerals have been used, when appropriate, to designate the same or similar elements that are common to the figures. Further, unless stated otherwise, the drawings shown and discussed in the figures are not drawn to scale, but are shown for illustrative purposes only.

DETAILED DESCRIPTION OF THE PREFERRED EMBODIMENTS

The present invention is a collapsible ice bucket for transporting, displaying, chilling and serving a bottle of wine, spirits or other types of beverages in a container. The ice bucket can illustratively be utilized in various ways, illustratively, from the point of sale of the beverage at a retail store or distributor to the consumption of the beverage by the consumer.

For example, when a consumer purchases a bottle of wine at the liquor store or distributor, the retailer can place the bottle in the collapsible ice bucket of the present invention so that the purchasing consumer can transport the wine bottle to a particular destination. Preferably, the ice bucket is a formed as a rectangular or square shaped gift bag and is fabricated from a transparent or translucent material to display the bottle in an aesthetically pleasing manner. Alternatively, the ice bucket can be cylindrical in shape or be fabricated from an opaque material. Printed and/or labeled advertising can be provided on the ice bucket as well. From the perspective of a retailer of the goods, the ice bucket of the present invention serves to display and advertise the contents after purchase and while the purchaser transports the bottled wine.

In another embodiment, the collapsible ice bucket is constructed from a water-impermeable material, so that the ice bucket can be filled with ice and water to chill the bottle, as required. Accordingly, the combination of the ice bucket and the bottled wine can be placed on a surface top at the user's home or other destination to display and chill the wine in a pleasing manner. The bottle can then be removed from the ice bucket to pour the wine, and then returned to the ice bucket for continued storage and temperature control. Accordingly, from the perspective of the purchaser, the purchaser can transport, display and chill the bottled wine with a single ice bucket and with minimal effort. Further, since the ice bucket can be shaped as a gift bag, the bottle of wine and ice bucket can be presented as a gift to others.

Although the present invention is described in terms of retaining and chilling a bottle of wine, a person of ordinary skill in the art will appreciate that the ice bucket of the present invention can be used to retain any other types of bottled or canned beverages, such as soda, beer, fruit drinks, and the like. Further, the ice bucket can also be used to retain non-beverage items, such as sealed or packaged foods (e.g., fruit, meats, cheese, among others). Moreover, as a gift bag it can also be used for packaging any type of product (e.g., non-food/beverage items), such as for example, golf balls, tee-shirts, among other products.

Referring now to FIG. 1, in a preferred embodiment, the collapsible ice bucket 100 comprises a front panel 102, an opposing back panel 104, a pair of side panels 106 and 108, and a bottom panel 110. The front and back panels 102 and 104 are positioned substantially parallel to each other and each includes an upper edge 112, a lower portion 114 and a pair of lateral edges 116. Similarly, the side panels 106 and 108 include an upper edge 122, a lower edge 124 and a pair of lateral edges 126.

Each lateral edge 116 of the front panel 102 is respectively joined to one of the lateral edges 126 of the side panels 106 and 108. Similarly, each lateral edge 116 of the back panel 104 is respectively joined to the other lateral edges 126 of the side panels 106 and 108. The bottom panel 110 is joined to the lower edges 124 of the side panels 106 and 108, and the lower portions 114 of the front and back panels 102 and 104. Accordingly, the front, back and side panels form a rectangular or square tube with the lower end of the tube closed with the substantially planar bottom panel 110. The ice bucket 100, as illustrated in FIG. 1 is shown in an open position, where an opening 130 formed by the lateral edges 116 and 122 provides access to the interior portion 132 of the ice bucket 100 such that a bottle 200 or other beverage container, water 202 (water line circumscribing bottle proximate ice cubes drawn in phantom) and/or ice 204 can be readily inserted therein and removed therefrom.

In one embodiment, the front panel 102 has a horizontal crease or fold near the lower portion of the ice bucket 100. The side panels 106 and 108 each have a pair of diagonal folds from the corners of the lower edges 124 and extending diagonally upward towards each other to form an isosceles triangle, where the lower edge of each side forms the hypotenuse of the triangle. Each side 106 and 108 includes a central longitudinal crease or fold that extends longitudinally from the apex of each diagonal fold to the upper edges 122 of each side 106 and 108. The creases or folds enable the ice bucket to be conveniently folded and flattened during nonuse and storage. Further, the ice bucket returns to and retains its opened non-folded state once the front and side panels are separated apart.

Figure 5:
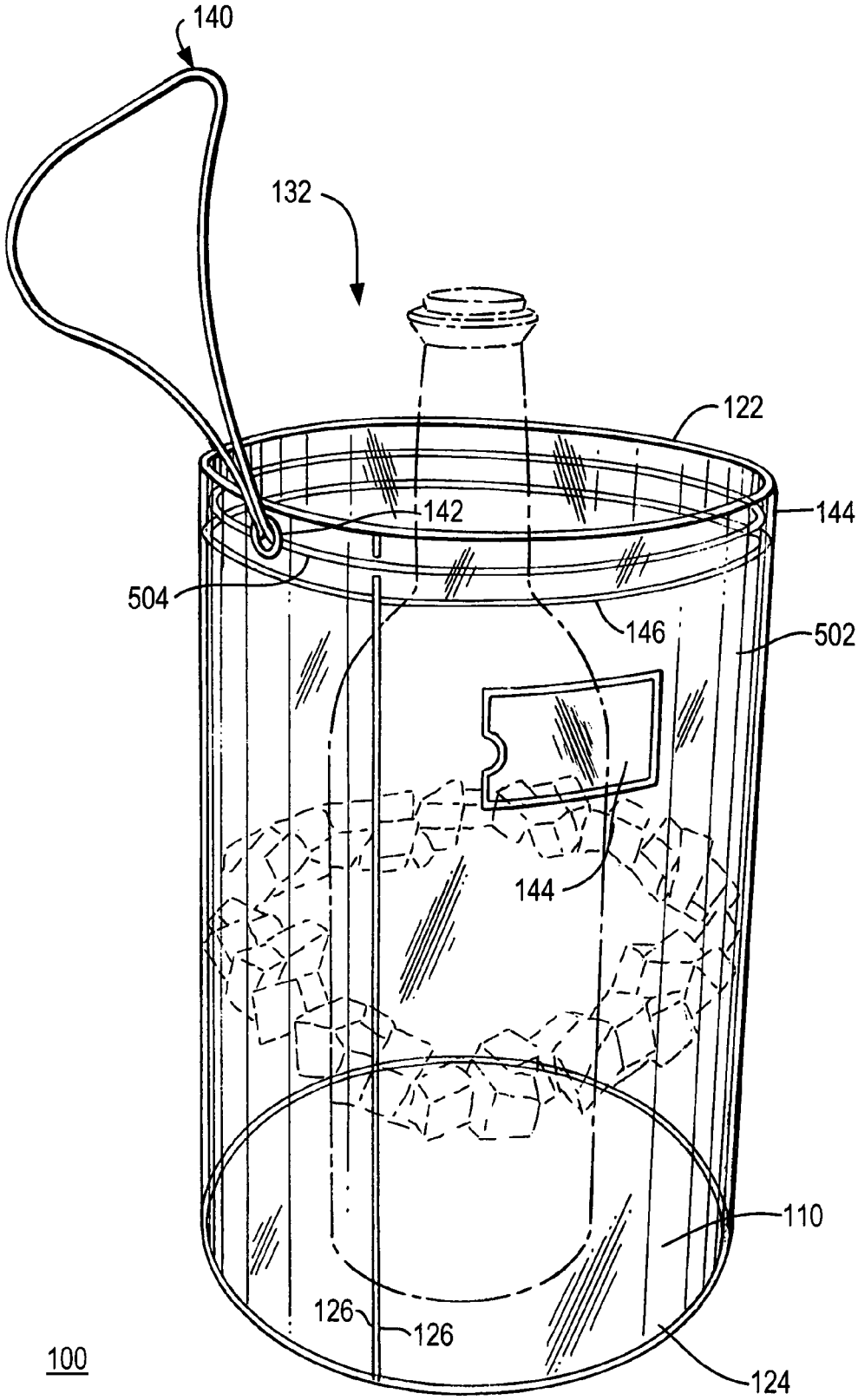
FIG. 5 is a front perspective view of another embodiment of a collapsible ice bucket of the present invention for carrying, displaying, chilling and serving a beverage in a beverage container.

FIG. 1 illustrates an embodiment of the ice bucket 100 wherein the height of the ice bucket is greater than the width, thus forming a rectangular ice bucket, suitable for tall, narrow beverage containers, such as a bottle of wine. It will be appreciated by those of ordinary skill in the art for which the invention pertains that the dimensions of height, length, and depth can be altered to form a wide variety of ice bucket shapes. For example, the embodiment described below with respect to FIG. 5 illustrates a cylindrical ice bucket.

The panels 102, 104, 106, 108 and 110 of the ice bucket 100 are fabricated from a flexible water-impermeable material, such as polyvinyl chloride, or polypropylene, among other materials that restrict the penetration, seepage or passage of liquids over extended periods of time. For example, when the ice bucket is used under normal wear-and-tear circumstances, without being subject to extreme external factors such as physical abuse, abnormally high or cold temperatures, and the like, the ice bucket can remain impermeable to water and retain its flexibility for extended periods (e.g., years).

The panels 102, 104, 106, 108 and 110 can have a thickness in the range of approximately 0.3 millimeters (mm) to 1.0 mm, and preferably have a thickness of approximately 0.5 mm. The thickness of the panels advantageously helps maintain the ice bucket in an upright or erect position when the beverage container (e.g., a wine bottle), ice and water are deposited in the interior portion of the ice bucket.

In one embodiment, the ice bucket 100 is formed from three water-impermeable panels. In particular, the front, bottom and back panels 102, 104 and 110 are formed from a single contiguous sheet of the water-impermeable material, while each of the pair of side panels is formed from a separate sheet of the water-impermeable material. The single contiguous sheet has a length that is sized to form the front panel 102, the bottom panel 110 and the back panel 104. The contiguous sheet is twice folded or creased (as illustrated by reference no. 128 in FIG. 1) to form a flattened U-shaped sheet, where the middle section of the contiguous sheet forms the substantially flat bottom panel 110 and the opposing lateral portions of the sheet form the front and back panels 102 and 104.

The opposing lateral edges 126 of the side panels 106 and 108 are preferably welded in a conventional manner between opposing lateral edges 116 of the front and back panels 102 and 104, to thereby form the rectangular or square shaped ice bucket. Further, the opposing lateral edges 130 (FIG. 4) of the bottom panel 110 are preferably welded between the lower edges 124 (FIG. 1) of the side panels 106 to thereby close and seal the bottom panel 110 with the side panels 106 and 108.

In an alternate embodiment, the ice bucket 100 is formed from five water-impermeable panels. In particular, the front panel 102, bottom panel 110, back panel 104 and side panels 106 and 108 are formed from separate sheets of the water-impermeable material, and are welded along their lateral edges in a conventional manner described above to form the water-impermeable ice bucket of the present invention.

It is noted that the bottom panel 110 can be formed as part of a contiguous sheet used to form the side panels. Further, it is noted that any number of panels can be formed from a contiguous sheet in order to reduce the welding process. For example, the ice bucket can be formed from four panels, where the bottom panel 110 is contiguous with one of the side, front or back panel regions. Further, for any of the embodiments described herein where the lateral edges of the panels are welded, preferably the corners are generally rounded as illustratively shown by reference "A" in FIG. 3.

Figure 6:
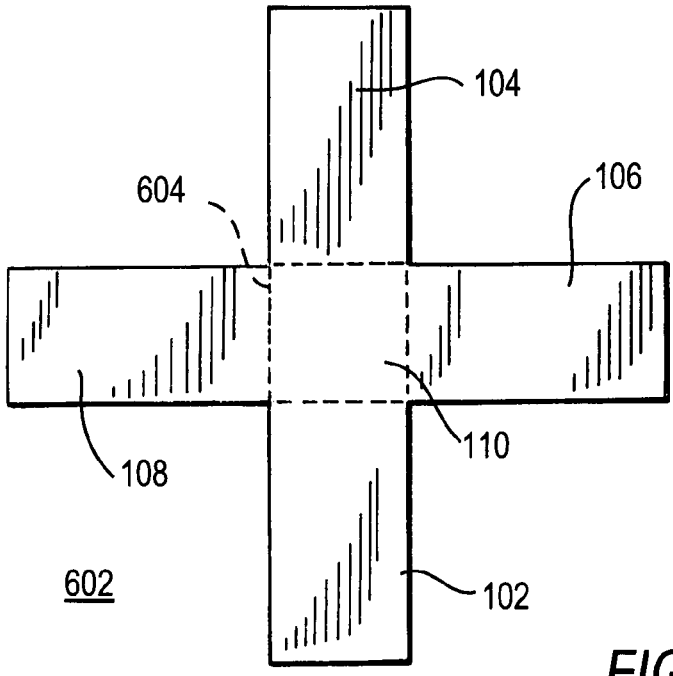
FIG. 6 is a top plan view of a precut sheet of polymeric material shaped to form the ice bucket of FIG. 1.

Referring to FIG. 6, a single contiguous sheet 602 of polymeric material is cut in the shape of a cross. The center portion of the cross-shaped sheet forms the substantially flat bottom panel 110, and the four panels 102, 104, 106 and 108 are folded in a common vertical direction along the broken lines 604 to form the front, side and back panels. The edges of the adjacent panels are joined together, preferably by welding, as discussed above to form the rectilinear ice bucket. In this configuration, only four welding operations are required, i.e., a welding operation between each of the adjacent panels. Although the present invention is depicted as a square or rectangular shaped ice bucket, a person of ordinary skill in the art for which the invention pertains will appreciate that any number panels can be provided and joined together to form a polygonal shaped ice bucket of the present invention.

Referring now to FIG. 5, yet another embodiment of the present invention is shown. The ice bucket 100 is formed from two panels, where a first panel includes an upper edge 122, a lower edge 124 and a pair of opposing lateral edges 126. The lateral edges are joined preferably by welding (e.g., hot gas welding, high-frequency welding, ultrasonic welding, among other well-know plastic welding or bonding techniques) to form a tube. The width of the first panel, and accordingly, the diameter of the tube is a matter of design choice. The second panel forms the bottom panel 110 of the ice bucket and is sized to have a diameter to correspond with the diameter of the tube. The lateral edge of the bottom panel is preferably welded to the lower edge 124 of the first panel to form a cylindrical ice bucket.

In any of the embodiments illustrated in FIGS. 1, 5 and 6, the upper edges 112 and 122 of the vertical panels are preferably double layered. That is, the upper edges 112 and 122 of the ice bucket can be fabricated such that the edges 112 and 122 have a double material thickness. As a result of this double-material thickness, the double thick water-impermeable material enhances the strength, as well as the decorative quality and safety of the ice bucket 100. The width of the double layered edges 112 and 122 as measured along the longitudinal axis of the ice bucket is a matter of design choice. However, as discussed below in further detail, it is preferable to provide a width suitable for facilitating the one or more handles 140 extending from the upper edge of the ice bucket.

In one embodiment the double layer is formed by folding the end of each panel outward and over itself, and then welding the ends horizontally along the sides of the panels. As shown in FIG. 1, the double layered material 144 is folded over such that the fold or crease forms the upper edge 112. The end of the panel is welded at 146 along the corresponding external surface of the front, back, and side panels 102, 104, 106 and 108.

Similarly, referring now to FIG. 5, the double layered material 144 is folded over such that the fold or crease forms the upper edge 122. The end of the panel is welded circumferentially at 146 along the corresponding external surface of the panel 502.

The ice bucket 100 includes at least one handle 140 extending from at least one of the upper edges 112 and 122 of the ice bucket. Referring to FIG. 1, the ice bucket 100 is preferably provided with a pair of flexible handles 140, where one handle is connected to front panel 102 and the other handle is connected to the back panel 104. The handles 140 can be of any suitable type and, as illustrated, may be formed of a relatively flexible material, such as tubing, cord, ribbon, among other flexible materials. The handles 140 can be attached and secured to the ice bucket in any suitable fashion.

In the embodiment shown in FIG. 1, the handles 140 are attached by inserting each end through one of a pair of apertures 142 formed in both the front panel 102 and the back panel 104. Each end of the handles 140 is knotted to prevent the handle end from slipping back through the handle aperture 142. The thickness of the double layered material 144 along the upper edge of the front, back and side panels 102, 104, 106 and 108 is sufficient to avoid the lining of the apertures 142 with grommets, such as plastic or metal grommets under normal usage. However, where it is envisioned that relatively heavy objects will be carried in the ice bucket, such as a large ice bucket for holding multiple bottles, the grommets can be used to prevent the handles 140 from tearing through the apertures 142.

Although the handles 140 are illustratively described as having the opposing ends being knotted to prevent slippage through the aperture 142, a person of ordinary skill in the art will appreciate that alternative embodiments can be implemented to secure the handles 140 to the ice bucket 100.

Figure 7A:
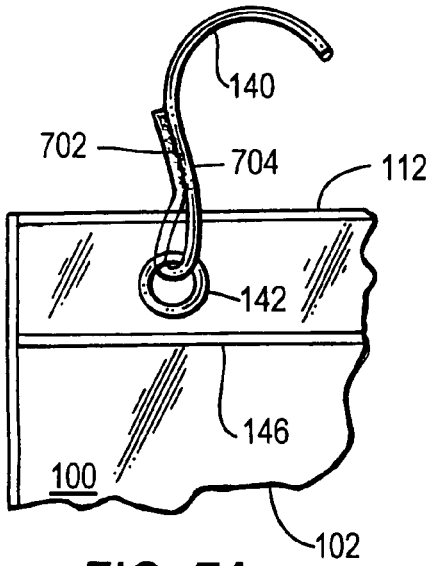
FIGS. 7A-7F are partial exploded views of the ice bucket illustrating various techniques for attaching a handle to the collapsible ice bucket.
Figure 7B:
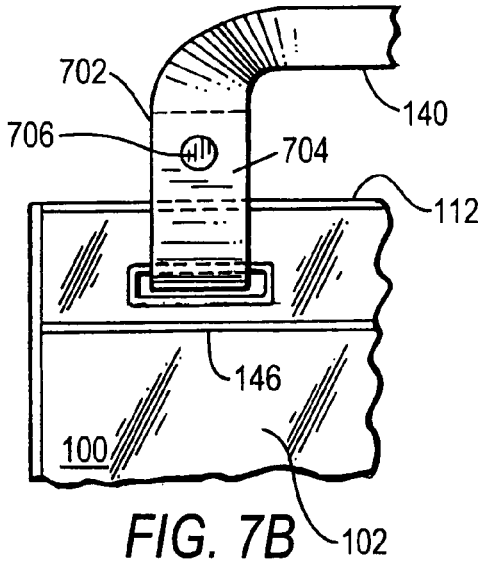
Figure 7C:
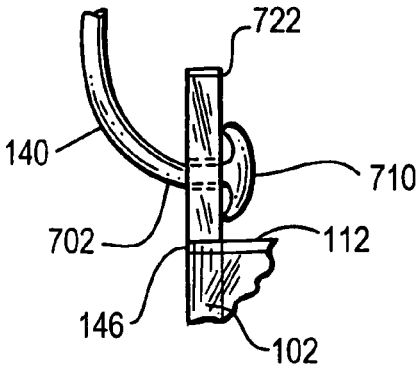
Figure 7D:
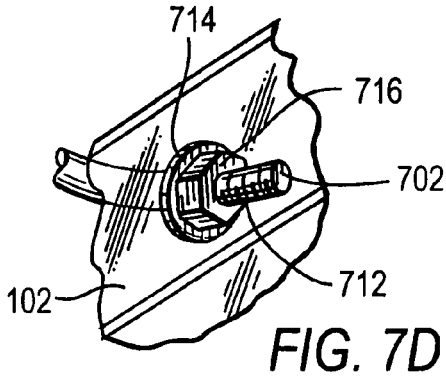
Figure 7E:
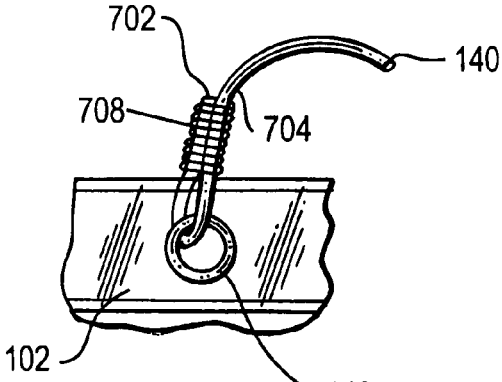

Referring to FIGS. 7A-7F, for example, in one alternative embodiment, the each end of the handles 140 can first pass through the corresponding handle aperture 142 and then be folded back over itself. The end of the handle 702 can be attached to an adjacent segment 704 by welding as shown in FIG. 7A, a fastener such as a rivet 706 as shown in FIG. 7B, as well as wrapping a secondary fastener, such as wire or a cord-like material 708, as shown in FIG. 7E. Alternatively, the end 702 of the handle 140 can include a substantially perpendicular or a bulbous (e.g., mushroom cap) shaped member 710 affixed thereto. The perpendicular or bulbous shaped member 710 has a length or diameter that is sized greater than the diameter of the aperture 142 to secure the end 702 of the handle 140 through the aperture 142, as shown in FIG. 7C. Also shown in FIG. 7C is an extension member 722, which can optionally be used to facilitate placement of the aperture 142 for receiving the end 702 of the handle 140.

Figure 7F:
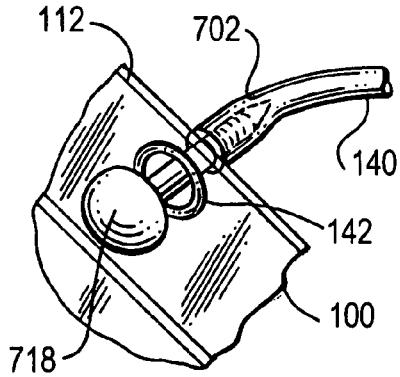

Referring to FIG. 7D, each end 702 of the handle 140 can be threaded to receive a corresponding washer 714 and retaining nut 716, such that the washer 714 and retaining nut 716 are sized greater than the diameter of the aperture 142 to secure the end 702 of the handle 140 through the aperture 142. Referring to FIG. 7F, a plug 718 having a diameter greater than the size of the aperture 142 can be inserted into the end 702 of the tubular handle to secure the end 702 of the handle 140 through the aperture 142. A person of ordinary skill in the art will appreciate that other well-known techniques can be implemented to secure the handle 140 to the ice bucket 100.

Although the handles 140 are illustrated as lying on the outside surface of the front and back panels 102 and 104, the handles 140 can alternatively extend from the side panels 106 and 108 and/or be relatively rigid and extend generally upwardly from the upper edge 112 of the front and back panels 102, 104 or side panels 106 and 108.

Referring now to FIG. 5, a single handle 140 is illustratively provided to carry the ice bucket 100. The upper portion of the ice bucket proximate the upper edge 112 includes the double layered material 144, where a channel 504 is formed therebetween, and at least one aperture 142 is formed through at least one layer of the channel 504. The handle 140 is in the form of a loop that includes a first portion that is threaded through at least one aperture 142 into the channel 504 that circumscribes the upper edge of the ice bucket, and a second portion that extends externally from the aperture 142. In this manner, the external portion of the handle can be used to carry the ice bucket, as well as pulled to tighten and close the opening 132 of the ice bucket. Conversely, the side of the panel 502 can be expanded outwards to open the opening 132 of the ice bucket 100.

The collapsible ice bucket 100 of the present invention can be used to advertise the distributor's or retailer's business. In one embodiment, text and/or designs can be printed on one or more panels. Thus, a retailer or distributor can advertise their name or logo, as well as display the beverage container to the general public as the container is being transported by the purchaser to the destination.

In another embodiment, an external pocket 144 is provided, illustratively to permit the insertion of a business card or gift card. Preferably, the external pocket is rectangular in shape and is welded on three sides to one of the front, back, or side panels. Referring to FIG. 1, the external pocket 144 is illustratively welded along three sides to the back panel 104. Referring to the embodiment of FIG. 5, the external pocket 144 is welded to the panel 502 in a well known manner.

Attaching a business card to the ice bucket 100 provides several advantages. For example, it is often desirable to receive a business card along with the contents contained in the ice bucket. Such business cards typically serve the purposes of identifying the source of the ice bucket and contents with the name of its retailer or distributor. Additionally, the external pocket 144 provides a convenient means of ensuring the business card and ice bucket remain together.

Figure 8:
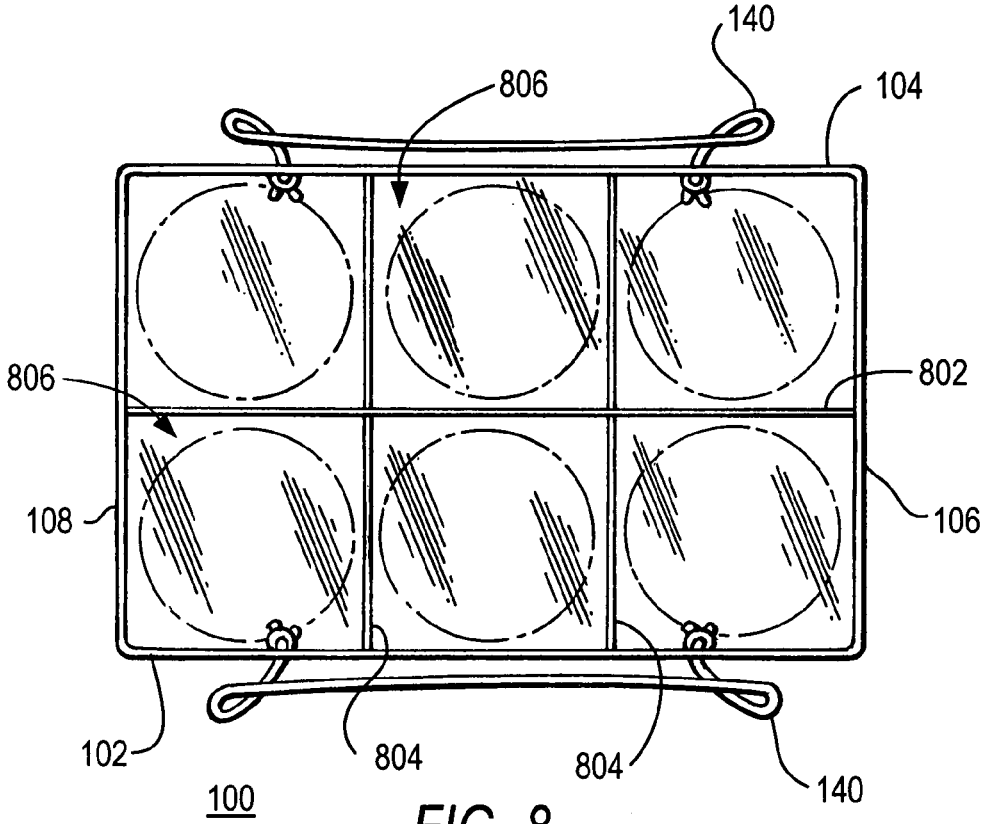
FIG. 8 is a top plan view of another embodiment of the collapsible ice bucket showing the general configuration with multiple sections.

FIG. 8 is a top plan view of another embodiment of the collapsible ice bucket 100 showing the general configuration with multiple cells or sections 806. The ice bucket of FIG. 8 can be used for carrying and chilling, for example, a six-pack of beer, among other beverages or items. In the illustrative embodiment shown, a rectangular ice bucket 100 includes a first divider member 802 extending centrally across the width of the ice bucket parallel to and between the side panels 106 and 108. A pair of evenly spaced second divider members 804 extends perpendicular to the first divider member 802 between the front and back panels 102 and 104 to form six sections 806. The divider members 802 and 804 are preferably fabricated from a flexible water-impermeable material, such as polyvinyl chloride, or polypropylene, among other materials that restrict the penetration, seepage or passage of liquids over extended periods of time. Each section or compartment holds a corresponding beverage container or other item as illustratively drawn in phantom.

Figure 9:
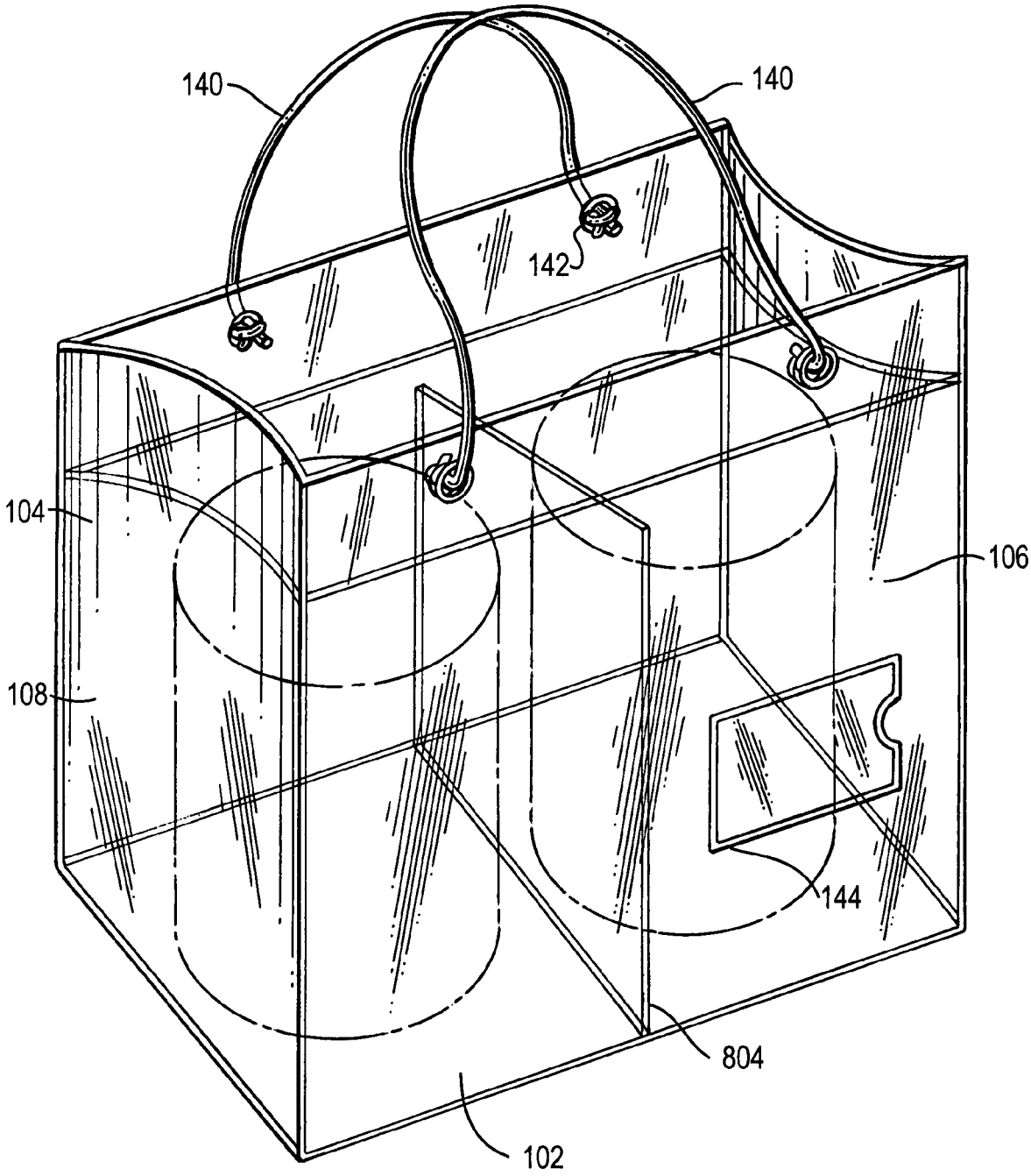
FIG. 9 is a top perspective view of yet another embodiment of the collapsible ice bucket showing the general configuration with multiple sections.

Referring now to FIG. 9, an illustrative collapsible ice bucket 100 includes a single divider 804 extending between the front panel 102 and the back panel 104 to form two sections or compartments 806. A person of ordinary skill in the art will appreciate that the number of dividers and sections shown with regard to FIGS. 8 and 9 is not considered limiting. For example, two dividers in parallel for retaining three items, two dividers that are positioned perpendicular for retaining four items, among other quantities and arrangements of dividers formed in the ice bucket of the present invention.

Although the collapsible ice buckets of the present invention are described in terms of being transparent, a person of ordinary skill in the art will appreciate that the ice buckets can be or include translucent portions. Alternatively, portions or all of the ice bucket can be tinted with coloring that is attractive. The appearance of the transparent or translucent material also lends ice buckets of the present invention an air of quality and permanence that enhances both the prestige of the contents therein and the good feelings associated with displaying the contents.

Ice buckets constructed from the above-described water-impermeable transparent material also have rounded corners of the welded panels. Advantageously, the rounded corners are more resistant to bending and cracking than those ice buckets having pointed welds at the corners. Further, the rounded corners give the ice bucket of the present invention an aesthetically softer look. Another advantage of the soft edges and round corners of the present invention is the prevention of potential cuts, scrapes, among other injuries associated with ice buckets having thin paper edges and stiff pointed corners.

Although an exemplary description of the invention has been set forth above to enable those of ordinary skill in the art to make and use the invention, that description should not be construed to limit the invention, and various modifications and variations may be made to the description without departing from the scope of the invention, as will be understood by those with ordinary skill in the art, and the scope thereof is determined by the claims that follow.

I claim:

1. A collapsible ice bucket for carrying, displaying, chilling and serving a beverage in a beverage container, comprising:

substantially parallel front and back panels, each having an upper edge, a lower portion, and two lateral edges;

a pair of side panels, each having an upper edge, a lower edge, and two lateral edges, wherein the lateral edges of the front and back panels are joined to the adjacent lateral edges of the side panels;

a bottom panel having at least one pair of opposing lateral edges, wherein the lateral edges of the bottom panel are joined to the lower edges of the side panels to form an interior portion of said ice bucket defined by the front, back, pair of side panels and the bottom panel, and an opening defined as the distance between the upper edges of the front, back and side panels;

said front, back, side and bottom panels of said ice bucket being formed from a deformable, water-impermeable material for displaying and chilling said beverage container, the lateral edges of the front and back panels being welded to the opposing lateral edges of the side panels, and the pair of opposing lateral edges of the bottom panel being welded respectively to the lower edges of the side panels, wherein the welded edges of the panels have a thickness in the range of approximately 0.3 millimeters (mm) to 1 mm; the upper edges of the ice bucket having a double thickness of said deformable, water-impermeable material for retaining said opening in a substantially non-collapsed state; and at least one handle, wherein the at least one handle extends from at least one of the upper edges of the panels.

2. The ice bucket of claim 1, wherein said front, back, bottom, and side panels are formed from a flexible polymer material.

3. The ice bucket of claim 2, wherein said polymer material is polyvinyl chloride.

4. The ice bucket of claim 2, wherein said polymer material is polypropylene.

5. The ice bucket of claim 1, wherein the front, back and bottom panels are formed from a single contiguous sheet of said deformable, water-impermeable material.

6. The ice bucket of claim 1, wherein welded corners formed by the pair of lateral edges of the bottom panel and the lower edges of the side panels are generally rounded in shape.

7. The ice bucket of claim 1, wherein the welded edges of the panels have a thickness of approximately 0.5 mm.

8. The ice bucket of claim 1, wherein said bottom panel includes two pairs of substantially parallel opposing lateral edges forming a rectangular shape.

9. The ice bucket of claim 8, wherein one of the two pair of opposing lateral edges of the bottom panel are welded respectively to the lower edges of and therebetween the side panels, and the other pair of opposing lateral edges of the bottom panel are welded respectively to the lower portions of and therebetween the front and back panels.

10. The ice bucket of claim 9, wherein corners formed by the two pairs of lateral edges of the bottom panel, the lower edges of the side panels, and the lower portions of the front and back panels are generally rounded in shape.

11. The ice bucket of claim 9, wherein the welded edges of the panels have a thickness in the range of approximately 0.3 millimeters (mm) to 1 mm.

12. The ice bucket of claim 9, wherein the welded edges of the panels have a thickness of approximately 0.5 mm.

13. The ice bucket of claim 1, wherein said upper edges of the front, back and side panels are double layers of said water-impermeable material.

14. The ice bucket of claim 1, wherein the at least one handle comprises a pair of handles, wherein one handle is attached to the upper edge of the front panel and the other handle is attached to the upper edge of the back panel.

15. The ice bucket of claim 14, wherein said handles are attached to the front and back panels by passing them through a pair of apertures in each of said panels.

16. The ice bucket of claim 1, wherein said handles are formed from a flexible material.

17. The ice bucket of claim 1, further comprising at least one pocket mounted on at least one of the exterior surfaces of said front and back panels.

18. The ice bucket of claim 17, wherein said at least one pocket is transparent and sized to receive an advertisement.

19. The ice bucket of claim 1 further comprising a plurality of dividers extending between at least one of said front and back panels and between said side panels to form at least two interior sections.

20. The ice bucket of claim 1, wherein said deformable, water-impermeable material is at least one of a transparent and translucent material.

21. An ice bucket for carrying, displaying, chilling and serving a beverage in a beverage container, comprising:

a side panel having an upper edge, a lower edge, and two lateral edges, said lateral edges being joined to form a substantially cylindrical side wall;

a substantially circular bottom panel having a lateral edge, wherein the lateral edge of the bottom panel is welded to the lower edge of the substantially cylindrical side wall to form an interior portion therein, and having an opening width defined as the diameter along the upper edge of the panel, wherein the welded edges of the panels have a thickness in the range of approximately 0.3 millimeters (mm) to 1 mm;

said side wall and bottom panel of said ice bucket being formed from a deformable, water-impermeable material defining an interior portion which is dimensioned to retain water and/or ice and for displaying and chilling said beverage; the upper edges of the ice bucket having a double thickness of said deformable, water-impermeable material for retaining said opening in a substantially non-collapsed state; and at least one handle, wherein the at least one handle extends from the upper edge of the side panel.

22. The ice bucket of claim 21, wherein the side wall and bottom panel are formed from a flexible plastic material including polyvinyl chloride.

23. The ice bucket of claim 22, wherein the lateral edges of the side panel are welded together and the lateral edge of the bottom panel is welded to the lower edge of the side panel.

24. The ice bucket of claim 21 further comprising a plurality of dividers extending between at least one of said front and back panels and between said side panels to form at least two interior sections.

25. The ice bucket of claim 21, wherein the side wall and bottom panel are formed from a flexible plastic material including polypropylene.

26. A collapsible ice bucket for carrying, displaying, chilling and serving a beverage in a beverage container, comprising:

at least one side panel, each side panel having an upper edge, a lower portion, and two lateral edges, where adjacent lateral edges are welded to form a tubular structure sized to receive said beverage container, wherein the welded edges have a thickness in the range of approximately 0.3 millimeters (mm) to 1 mm;

a bottom panel joined to the lower portion of the at least one side panel to form an interior portion of said ice bucket defined by the at least one panel and the bottom panel, and an opening defined as the distance between opposing upper edges of the at least one panel;

said at least one panel and bottom panel of said collapsible ice bucket being formed from a deformable, water-impermeable material defining an interior portion which is dimensioned to retain water and/or ice and said beverage container; the upper edges of the ice bucket having a double thickness of said deformable, water-impermeable material for retaining said opening in a substantially non-collapsed state; and at least one handle, wherein the at least one handle extends from at least one of the upper edges of the panels.

* * * * *